US006041608A

United States Patent [19]

Fujiwara

[11] Patent Number: 6,041,608

[45] Date of Patent: Mar. 28, 2000

[54] LOW TEMPERATURE REFRIGERATING DEVICE HAVING SMALL REFRIGERATING CAPACITY CHANGE

[75] Inventor: Kenji Fujiwara, Osaka, Japan

[73] Assignee: Daikin Industriesm Ltd., Osaka, Japan

[21] Appl. No.: 09/000,350

[22] PCT Filed: Jul. 17, 1996

[86] PCT No.: PCT/JP96/01990

§ 371 Date: Jan. 16, 1998

§ 102(e) Date: Jan. 16, 1998

[87] PCT Pub. No.: WO97/04277

PCT Pub. Date: Feb. 6, 1997

[30] Foreign Application Priority Data

Jul. 19, 1995 [JP] Japan ..... 7-183126

[51] Int. Cl.[7] ..... F25B 39/04; F25B 19/02

[52] U.S. Cl. ..... 62/229; 62/51.2; 62/467

[58] Field of Search ..... 62/184, 51.2, 467

[56] References Cited

U.S. PATENT DOCUMENTS

| | | | |
|---|---|---|---|
| 3,967,172 | 6/1976 | Denny | 62/184 |
| 4,967,572 | 11/1990 | Strasser | 62/467 |
| 5,749,243 | 5/1998 | Lester | 62/51.2 X |

FOREIGN PATENT DOCUMENTS

| | | |
|---|---|---|
| 2-82059A | 3/1990 | Japan . |
| 5-302764 | 11/1993 | Japan . |
| 6-207757 | 7/1994 | Japan . |
| 6-249148 | 9/1994 | Japan . |
| 7-4761A | 1/1995 | Japan . |

*Primary Examiner*—William Wayner

*Attorney, Agent, or Firm*—Birch, Stewart, Kolasch & Birch, LLP

[57] ABSTRACT

There is provided a cryogenic refrigerating apparatus capable of reducing a fluctuation range of refrigerating capacity as far as possible with respect to a wide range of change in outdoor temperature and performing stable refrigerating operation. This cryogenic refrigerating apparatus includes a compressor unit 101 which is installed outside a room and has a compressor 11 and a first air-cooling heat exchanger 12, an intermediate unit 103 which is installed inside a room and has a second air-cooling heat exchanger 31 for cooling gas from the compressor 11 through heat exchange with indoor air and a cryogenic expander 5. There is provided a fan 33 for the second air-cooling heat exchanger 31 of the intermediate unit 103, and a controller 6 having an intermediate unit air flow control section 6*a* which controls an air flow of the fan 33 to an increasing side under a condition that temperature of gas supplied to the cryogenic expander 5 is not lower than a temperature at which refrigerating capacity starts to reduce due to a temperature rise and controls the air flow of the fan 33 to a decreasing side under a condition that the temperature of gas supplied to the cryogenic expander 5 is lower than the temperature at which the refrigerating capacity starts to reduce due to a temperature rise.

5 Claims, 5 Drawing Sheets

LOW TEMPERATURE REFRIGERATING DEVICE HAVING SMALL REFRIGERATING CAPACITY CHANGE

This application is the national phase under 35 U.S.C. §371 of prior PCT International Application No. PCT/JP 96/01990 which has an International filing date of Jul. 17, 1996 which designated the United States of America, the entire contents of which are hereby incorporated by reference.

TECHNICAL FIELD

The present invention relates to a cryogenic refrigerating apparatus, and in particular, to a cryogenic refrigerating apparatus constructed of a compressor unit provided with a compressor and a first air-cooling heat exchanger provided in communication with discharge side piping of the compressor, an intermediate unit provided with gas supply piping connected to the discharge side piping of the compressor and a second air-cooling heat exchanger which is provided in communication with the gas supply piping and cools a gas through heat exchange with air inside a room and a cryogenic expander connected to the gas supply piping, the compressor unit being able to be installed outside the room and the intermediate unit being able to be installed inside the room, whereby helium gas discharged from the compressor is cooled by the first and second air-cooling heat exchangers and supplied to the cryogenic expander.

BACKGROUND ART

Conventionally, for the purpose of preventing the occurrence of operating noises of a compressor inside a room, a compressor unit has been provided outside the room and helium gas discharged from the compressor has been air-cooled by an air-cooling heat exchanger. However, since the cooling by the air-cooling heat exchanger installed outside the room is air-cooling, the helium gas cannot be cooled to a temperature lower than the air temperature by this air-cooling heat exchanger. Therefore, when the outdoor temperature is high in summer or in a similar case, the temperature of the helium gas supplied to the cryogenic expander is hard to be maintained at a temperature not higher than a temperature (35° C., for example) at which the insulating property of a motor is assured.

In view of the above, there is proposed a cryogenic refrigerating apparatus (Japanese Patent Laid-Open Publication No. HEI 6-249148) which can cool the helium gas to a lower temperature through two-stage cooling by installing a compressor unit provided with a compressor and a first air-cooling heat exchanger outside a room and installing an intermediate unit provided with a second air-cooling heat exchanger inside the room.

In this cryogenic refrigerating apparatus which performs the two-stage cooling, as shown in FIG. 7, a compressor unit 1 is constructed of a helium gas compressor 11, a first air-cooling heat exchanger 12 comprised of, for example, a cross fin coil provided in communication with discharge side piping 21 of this compressor 11 and an oil separator 13 provided in communication with the discharge side piping 21 on the outlet side of this first air-cooling heat exchanger 12, while an intermediate unit 3 provided with a second air-cooling heat exchanger 31 comprised of, for example, a cross fin coil is provided separately from this compressor unit 1, the compressor unit 1 being installed outside a room and the intermediate unit 3 being installed inside the room.

An end portion which belongs to the discharge side piping 21 connected to the discharge side of the compressor 11 is connected to gas supply piping 41 of the intermediate unit 3, while an end portion which belongs to an intake side piping 22 connected to the intake side of the compressor 11 is connected to gas return piping 42 of the intermediate unit 3.

The gas supply piping 41 of the intermediate unit 3 is connected to a high-pressure side communication piping 51 communicated with a cryogenic expander 5, while the gas return piping 42 of the intermediate unit 3 is connected to a low-pressure side communication piping 52 communicated with the cryogenic expander 5.

Further, the second air-cooling heat exchanger 31 is connected to the gas supply piping 41, an adsorber 32 is provided in communication with the outlet side of the second air-cooling heat exchanger 31 and the second air-cooling heat exchanger 31 is provided with a fan 33.

It is to be noted that oil collected in a bottom portion of the oil separator 13 is injected into a compression element of the compressor 11 via oil injection piping 23 and oil collected to a height higher than a specified oil surface height inside the oil separator 13 is returned from the intake side piping 22 into the compressor 11 via an oil return piping 24. On the other hand, oil collected in a bottom portion inside the compressor 11 is cooled in the first air-cooling heat exchanger 12 via an oil cooling piping 25 and thereafter returned from the intake side piping 22 into the compressor 11.

Then, in the first air-cooling heat exchanger 12 of the compressor unit 1 installed outside the room, by making compressed high-temperature helium gas to exchange heat with the outdoor air to firstly cool it by the outdoor air for the achievement of the greater part of the heat radiation of the helium gas outside the room and further cooling the helium gas by the second air-cooling heat exchanger 31 of the intermediate unit 3 installed inside the room, the compressed helium gas is cooled in two steps by the outdoor air and the indoor air. This arrangement has allowed the helium gas to be cooled to a temperature not higher than a specified temperature (35° C., for example) even when the outdoor temperature is high and prevented the operating noises inside the room with the compressor unit 1 installed outside the room.

In the cryogenic refrigerating apparatus constructed as above, the helium gas, of which cooling has been insufficient in the compressor unit 1, can be cooled in the intermediate unit 3. However, in regard to the cooling in the intermediate unit 3, constant cooling is consistently performed no matter whether the cooling capacity of the first air-cooling heat exchanger 12 of the compressor unit 1 depending on the outside air temperature is great or small, i.e., a fan 33 for cooling the second air-cooling heat exchanger 31 is driven to rotate consistently at a constant rotating speed so as to make the air flow constant. Therefore, when the outdoor temperature is low in winter, constant cooling is performed by the second air-cooling heat exchanger 31 regardless of the load from outside the room in spite of the fact that sufficient cooling has been performed in the first air-cooling heat exchanger 12, and this has resulted in excessive cooling and a significant change in refrigerating capacity, causing a disadvantage that a stable refrigerating operation can still not be performed.

Furthermore, although not shown in FIG. 7, the first air-cooling heat exchanger 12 of the compressor unit 1 is normally provided with an outdoor fan for cooling. When starting the refrigerating apparatus in a case where the outdoor temperature is extremely low in winter, the viscosity of the oil (mainly ether-based oil) inside the units 1 and 3 is very high. Therefore, when excessive cooling is performed by the operation of the outdoor fan at the first air-cooling heat exchanger 12, the viscosity of the oil does not reduce, and this has tended to cause a disadvantage that the units 1 and 3 do not correctly operate.

The present invention is intended to solve the aforementioned problems, and its principal object is to provide a cryogenic refrigerating apparatus capable of reducing the change in refrigerating capacity as far as possible with respect to a wide range of change in outdoor temperature and performing a stable refrigerating operation.

Another object is to allow the units to regularly operate by speedily reducing the viscosity of the oil even when the outdoor temperature becomes very low in winter.

DISCLOSURE OF THE INVENTION

A cryogenic refrigerating apparatus of the present invention comprises: a compressor unit which is installed outside a room and has a compressor and a first air-cooling heat exchanger provided in communication with a discharge side piping of the compressor; an intermediate unit which is installed inside the room and has a gas supply piping connected to the discharge side piping of the compressor and a second air-cooling heat exchanger which is provided in communication with the gas supply piping and cools helium gas through heat exchange with indoor air; and a cryogenic expander connected to the gas supply piping.

A fan is provided cooling the second air-cooling heat exchanger of the intermediate unit.

A controller is provided having an intermediate unit air flow control section which controls air flow of the fan to an increasing side under a condition that a temperature of gas supplied to the cryogenic expander is not lower than a temperature at which a refrigerating capacity starts to reduce due to a temperature rise and controls the air flow of the fan to a decreasing side under a condition that the temperature of the gas supplied to the cryogenic expander is lower than the temperature at which the refrigerating capacity starts to reduce due to the temperature rise.

With this arrangement, the air flow of the fan in the intermediate unit is increased to improve the cooling capacity of the second air-cooling heat exchanger when the outdoor temperature is high and the temperature of the gas supplied to the cryogenic expander increases to a temperature at which the refrigerating capacity starts to reduce. When the refrigerating capacity is stable, the air flow of the fan is suppressed to prevent occurrence of supercooling in the intermediate unit.

Therefore, when the outdoor temperature is high to cause a reduction in the refrigerating capacity, the air flow of the fan of the intermediate unit is increased to improve the cooling capacity, so that the reduction in the refrigerating capacity can be prevented. When the cooling capacity is stable, the air flow of the fan is not increased, so that supercooling in the intermediate unit can be prevented. Therefore, the cooling in the intermediate unit can be effectively performed in accordance with the cooling capacity of the compressor unit depending on the outdoor temperature, and the fluctuation range of the refrigerating capacity can be reduced as far as possible with respect to a wide range of change in outdoor temperature, thereby allowing a stable refrigerating operation to be performed.

Furthermore, the fan of the intermediate unit can be stopped when sufficient cooling can be executed in the compressor unit. Therefore, unnecessary operation can be eliminated, so that operating life of the fan can be increased further than in the conventional case, thereby allowing a maintenance frequency to be reduced.

In one embodiment, an outdoor temperature sensor is provided outside the room and the controller controls the air flow of the fan of the intermediate unit based on a detection result of the outdoor temperature sensor.

With this arrangement, the outdoor temperature can be detected by the outdoor temperature sensor, and therefore, it can be found how much the first air-cooling heat exchanger of the compressor unit is cooled by the outside air, so that the cooling in the intermediate unit can be effectively performed in accordance with the cooling capacity of the compressor unit.

In one embodiment, an outdoor fan for cooling the first air-cooling heat exchanger of the compressor unit is provided, and the controller has an outdoor unit air flow control section which controls air flow of the outdoor fan to the decreasing side based on detection result of the outdoor temperature sensor when the outside air temperature is low and not higher than a temperature at which the refrigerating capacity starts to reduce.

With this arrangement, the outdoor fan is controlled to the air flow decreasing side even when the compressor unit is started when the outside air temperature is low and not higher than the temperature at which the refrigerating capacity starts to reduce. Therefore, the supercooling at the first air-cooling heat exchanger can be prevented, and consequently a temperature of oil of the compressor unit can be speedily increased to reduce viscosity of the oil by the operation of the compressor, thereby allowing a lubrication property in a starting stage to be improved. Therefore, the cryogenic refrigerating apparatus can be regularly operated even when the outside air temperature is low, so that a stable operation can be achieved.

In one embodiment, a first temperature sensor for detecting the temperature of the helium gas on an outlet side of the first air-cooling heat exchanger of the compressor unit and a second temperature sensor for detecting the temperature of the helium gas on an outlet side of the second air-cooling heat exchanger of the intermediate unit are provided, and the controller controls the air flow of the fan of the intermediate unit based on outputs of the first temperature sensor and the second temperature sensor.

With this arrangement, the compressed gas temperature can be more correctly detected, and this allows the cooling at the intermediate unit to be more effectively performed and allows the control to be performed so that the fluctuation range of the refrigerating capacity is further reduced.

In one embodiment, a gas temperature sensor for detecting the temperature of the gas on an inlet side of the cryogenic expander is provided, and the controller controls the air flow of the fan based on an output of the gas temperature sensor.

With this arrangement, the temperature of the gas immediately before the supply of the gas to the cryogenic expander can be detected. Therefore, more correct temperature detection can be achieved, and a fluctuation range of the refrigerating capacity can be further reduced. Furthermore, by detecting the temperature of the helium gas immediately before the supply of the gas to the cryogenic expander, a case where cooling is still insufficient in the second air-cooling heat exchanger can be detected. Therefore, the operating lives of the components inside the cryogenic expander when they receive a bad influence from the heated gas can be decided, so that possible occurrence of damage of the refrigerating apparatus by the heated gas can be detected beforehand, thereby allowing the refrigerating apparatus to be wholly protected by replacing each component or a similar measure.

BEST MODE FOR CARRYING OUT THE INVENTION

Figure 1:
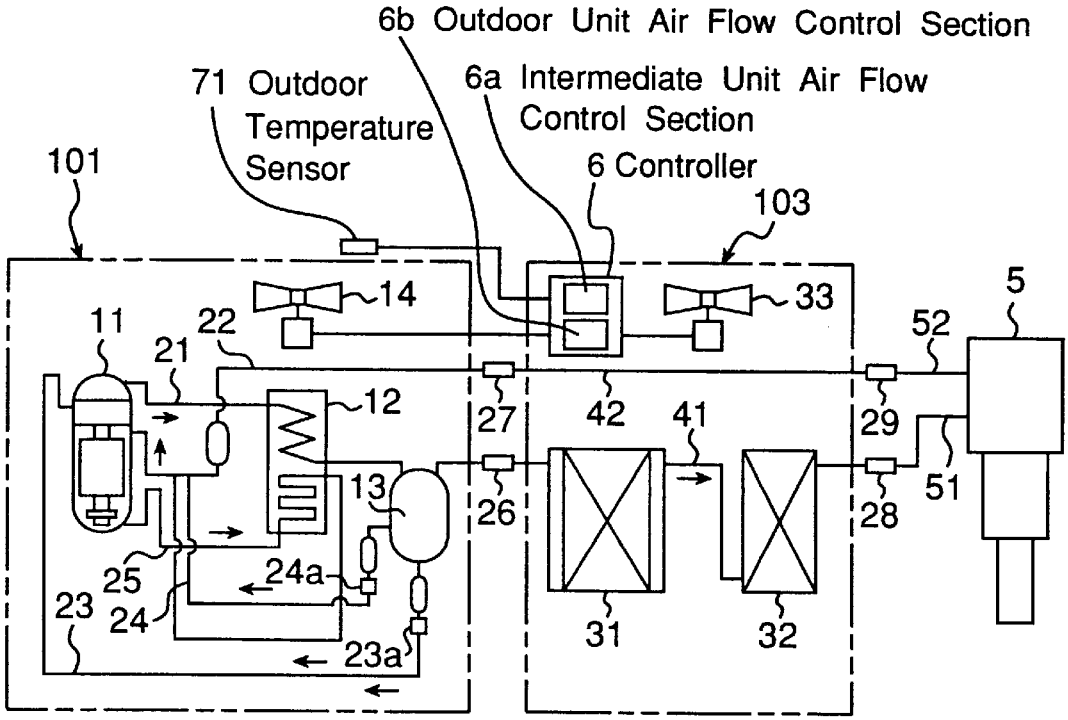
FIG. 1 is a diagram showing a piping system of a cryogenic refrigerating apparatus according to a first embodiment of the present invention.
Figure 7:
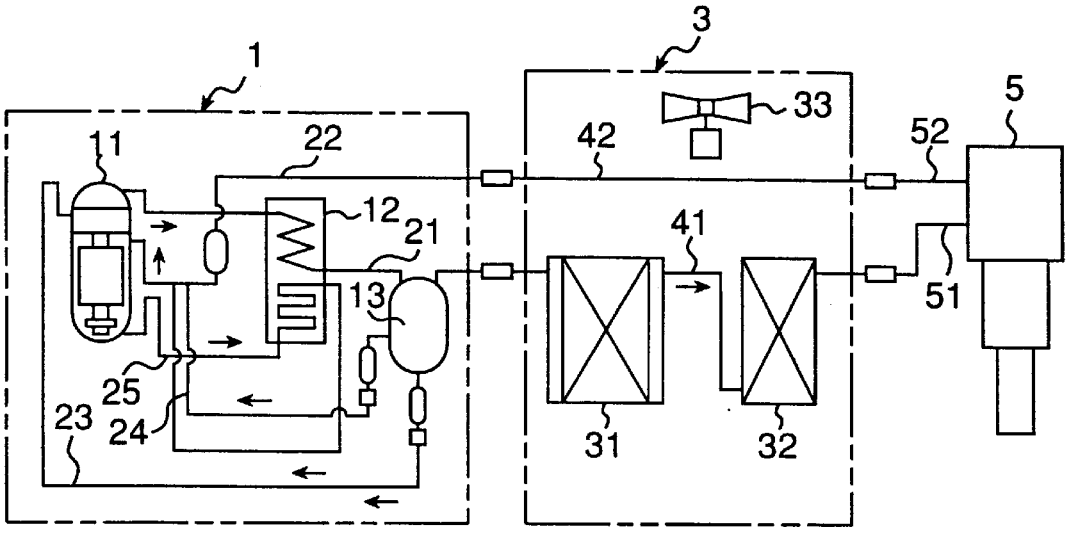
Fig.7 PRIOR ART
FIG. 7 is a diagram showing a piping system of a prior art.

The cryogenic refrigerating apparatus of the first embodiment shown in FIG. 1 has the same basic construction as that of the prior art shown in FIG. 7. Therefore, the same components are denoted by the same reference numerals, and no description is provided therefor.

Connection of discharge side piping 21 to gas supply piping 41, connection of intake side piping 22 to gas return piping 42, connection of the gas supply piping 41 to high-pressure side communication piping 51 and connection of the gas return piping 42 to low-pressure side communication piping 52 are achieved via connecting members 26, 27, 28 and 29, respectively.

Although not shown, a second air-cooling heat exchanger 31 is provided with a cross fin coil comprised of a heat exchanging tube connected to the gas supply piping 41 and a fin.

Further, the first air-cooling heat exchanger 12 is provided with an outdoor fan 14, thereby allowing helium gas to exchange heat with outside air to the full.

Further, an orifice 23*a* is provided in communication with oil injection piping 23, oil return piping 24 is connected at a specified oil surface height position of an oil separator 13, and an orifice 24*a* is provided in the middle of it.

Then, in a case where a compressor 11 of a compressor unit 101 is driven to operate a cryogenic expander 5 of the cryogenic refrigerating apparatus in the cryogenic refrigerating apparatus having the aforementioned construction, high-temperature helium gas discharged from the compressor 11 firstly exchanges heat with outside air in the first air-cooling heat exchanger 12 so as to be cooled. The helium gas which has discharged the greater part of heat outside a room through this cooling is further cooled by a second air-cooling heat exchanger 31 of an intermediate unit 103 installed inside the room. By thus performing the cooling in two steps through the cooling with outside air and the cooling with indoor air, the helium gas can be cooled to a temperature not higher than a specified temperature (32° C., for example) while suppressing the possible increase of the air conditioning load inside the room in which the expander 5 is installed. Further, with the arrangement that the intermediate unit 103 is provided separately from the compressor unit 101 so as to allow the compressor unit 101 to be installed outside the room, the problem of the operating noises can be avoided.

In a case where the cooling was performed only by the compressor unit 101, it was found that the refrigerating capacity was almost stabilized when outdoor air temperature was in a range of 12° C. to 32° C. and the refrigerating capacity started to reduce when the outdoor air temperature became higher than about 32° C. or lower than about 12° C. Therefore, according to the first embodiment, the cryogenic refrigerating apparatus having the aforementioned construction is provided with a controller 6 including an intermediate unit air flow control section 6*a* which controls the air flow of the fan 33 to the increasing side under the condition that the temperature of the gas supplied to the cryogenic expander 5 becomes not lower than a temperature at which the refrigerating capacity starts to reduce (when the outdoor air temperature is not lower than 32° C., for example) due to a temperature rise and controls the air flow of the fan 33 to the decreasing side under the condition that the temperature of the gas supplied to the cryogenic expander 5 becomes lower than the temperature at which the refrigerating capacity starts to reduce due to a temperature rise; and an outdoor unit air flow control section 6*b* which controls the air flow of the outdoor fan 14 to the decreasing side when the outside air temperature is not higher than temperature at which the refrigerating capacity starts to reduce (when the outside air temperature is not higher than 12° C., for example).

Although not shown, the controller 6 also executes start and stop control of the compressor 11 and switching control of a valve motor of the expander 5 in addition to air flow control of the fans 14 and 33.

Further, an outdoor temperature sensor 71 is provided on the downstream side of the outdoor fan 14 in the compressor unit 101, and a detection result of this outdoor temperature sensor 71 is transmitted to the controller 6. In addition, the outdoor fan 14 and the fan 33 of the intermediate unit 103 are connected to the controller 6, and the air flow control including the start and stop of the fans 14 and 33 is executed by the controller 6.

Next, the air flow control of the fans 14 and 33 by the controller 6 in the first embodiment will be described with reference to the flowchart of FIG. 4. It is now assumed that an outdoor temperature of 32° C. at which the refrigerating capacity starts to reduce due to a gas temperature rise is a set temperature t1 and a low outside air temperature of 12° C. at which refrigerating operation is not stabilized is a set temperature t2. First, upon starting the operation of the cryogenic refrigerating apparatus, a start command for the compressor unit 101 is outputted from the controller 6 (S1), and in accordance with this start command, an outdoor temperature t is detected by the outdoor temperature sensor 71 (S2). When this outdoor temperature, or the detection temperature t is higher than the set temperature t1 at which the refrigerating capacity starts to reduce due to a gas temperature rise, the fan 33 of the intermediate unit 103 starts to operate (S4) and the compressor 11 of the compressor unit 101 is started. Further, the temperature t is detected by the outdoor temperature sensor 71. When this detection temperature t still remains higher than the set temperature t1 (32° C.), the air flow of the fan 33 of the intermediate unit 103 is increased (S4).

When the detection temperature t is lower than the set temperature t1, it is decided whether or not the detection temperature t is within a range of the set temperature t1 (32°

C.) to the set temperature t2 (12° C.) (S5). When the detection temperature is in the range, the fan 33 of the intermediate unit 103 is kept stopped immediately after the start command. During the operation of the compressor 11, the air flow of the fan 33 is decreased or the fan 33 is stopped (S6).

When the detection temperature t is out of the range of the set temperature t1 to the set temperature t2 and is lower than the set temperature t2 (S5, S7), the outdoor temperature is very low. Accordingly, the outdoor fan 14 of the compressor unit 101 is stopped for a specified time (2 to 3 minutes, for example) for the suppression of the cooling of the first air-cooling heat exchanger 12 of the compressor unit 101 for a specified time and thereafter restarted (S8).

Figure 4:
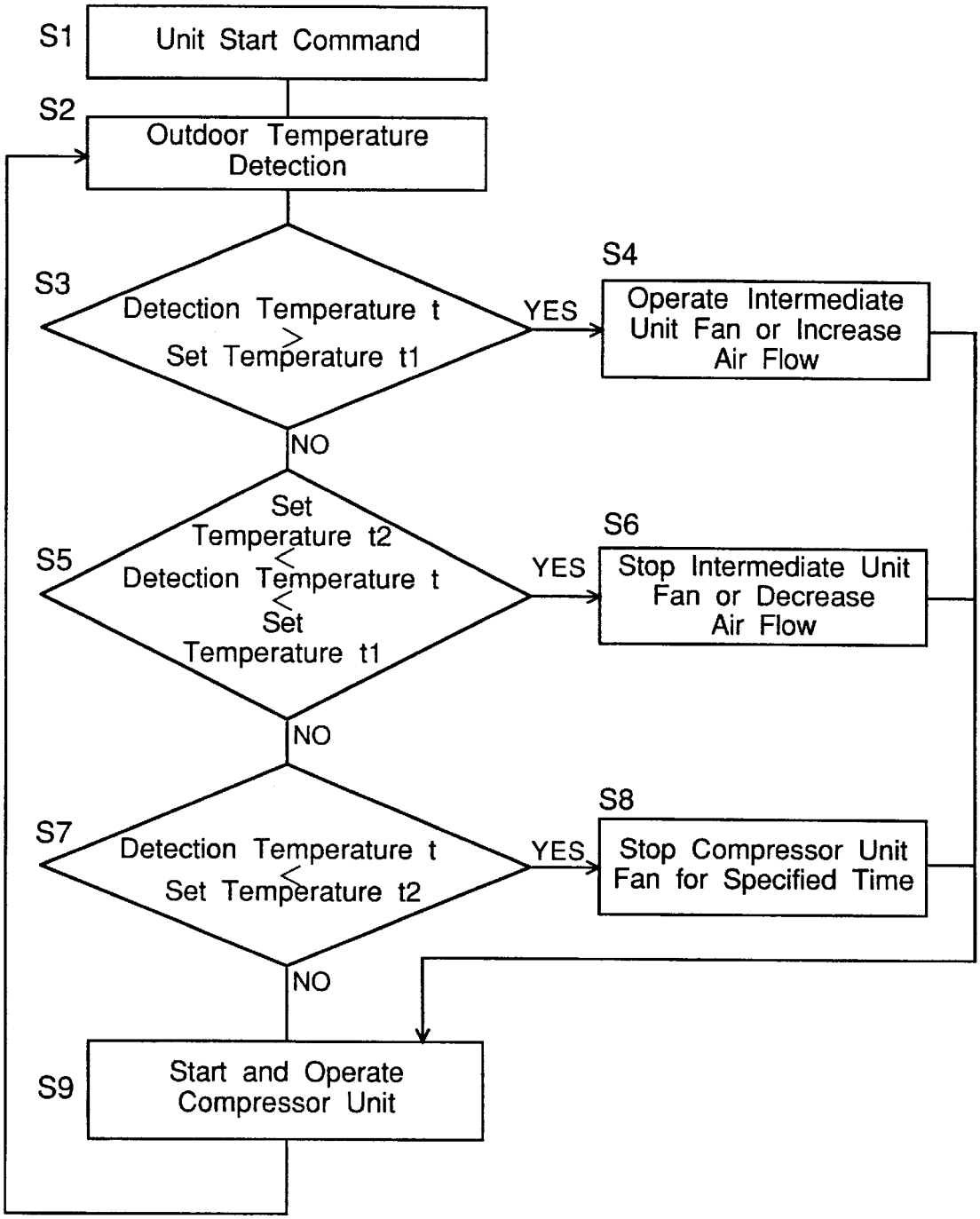
FIG. 4 is a flowchart showing fan control in the first embodiment.

As described above, the outdoor temperature detection is repeated as shown in the flowchart of FIG. 4, and the detection temperature t is compared with the set temperatures t1 and t2 every time it is detected, and the air flow control of the fan 33 of the intermediate unit 103 and the outdoor fan 14 of the compressor unit 101 is executed.

In the first embodiment, by executing the control as described above, the air flow of the fan 33 of the intermediate unit 103 is increased to improve the cooling capacity of the second air-cooling heat exchanger 31 in the intermediate unit 103 when the outdoor temperature is high and the temperature of the gas supplied to the cryogenic expander 5 rises to a temperature not lower than the temperature (t1) at which the refrigerating capacity starts to reduce. When the refrigerating capacity is stable (t2<t<t1), the air flow of the fan 33 is not increased, so that the supercooling in the intermediate unit 103 can be prevented.

Therefore, at a high outdoor temperature at which the refrigerating capacity reduces, the cooling capacity of the intermediate unit 103 with the fan 33 is improved, so that the decrease of the refrigerating capacity can be prevented. When the refrigerating capacity is stable, the air flow of the fan 33 is not increased, so that the supercooling in the intermediate unit 103 can be prevented. Consequently, the cooling in the intermediate unit 3 can be effectively performed in accordance with the cooling capacity of the compressor unit 101 depending on the outdoor temperature, so that the fluctuation range of the refrigerating capacity can be reduced as far as possible with respect to a wide range of change in outdoor temperature, thereby allowing a stable cooling operation-to be performed.

When sufficient cooling can be performed in the compressor unit 101, the fan 33 of the intermediate unit 103 can be stopped. Therefore, unnecessary operation can be eliminated, so that the operating life of the fan 33 can be made longer than in the conventional case, thereby allowing the maintenance frequency to be reduced.

Furthermore, the air flow of the outdoor fan 14 is controlled to the decreasing side when the outside air temperature is low to cause the outdoor temperature to be not higher than the temperature (t2) at which the refrigerating capacity starts to reduce. With this arrangement, the outdoor fan 14 is controlled to the air flow decreasing side even though the compressor unit 1 is started when the outside air temperature is low to cause the outdoor temperature to be not higher than the temperature (t2) at which the refrigerating capacity starts to reduce. Therefore, the supercooling in the first air-cooling heat exchanger 12 can be prevented and consequently the temperature of the oil inside the compressor unit 101 can be speedily increased to allow the viscosity of the oil to be reduced by the operation of the compressor 11, so that the reduction of the refrigerating capacity can be prevented by improving the lubrication property in the starting stage. The cryogenic refrigerating apparatus can be regularly operated even at a low outside air temperature, so that a stable operation can be achieved.

Furthermore, the outdoor temperature can be detected by the outdoor temperature sensor 71, with which it can be found how much the first air-cooling heat exchanger 12 in the compressor unit 101 is cooled by the outside air, so that the cooling in the intermediate unit 103 can be effectively performed in accordance with the cooling capacity of the compressor unit 101.

Figure 2:
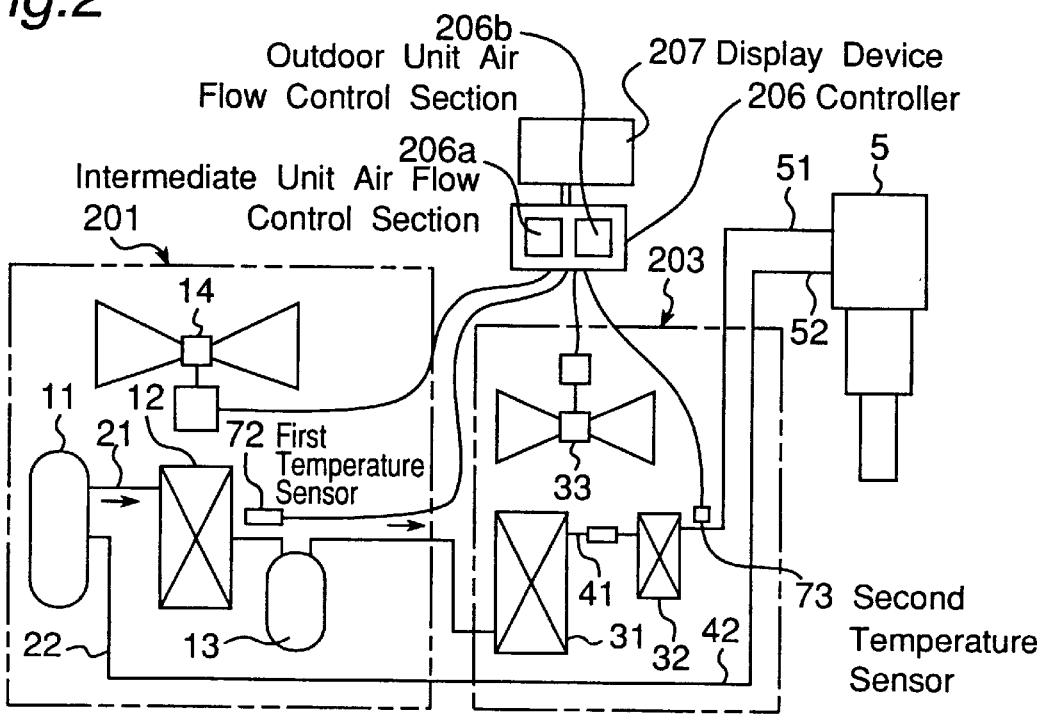
FIG. 2 is a diagram showing a piping system of a cryogenic refrigerating apparatus according to a second embodiment of the present invention.
Figure 5:
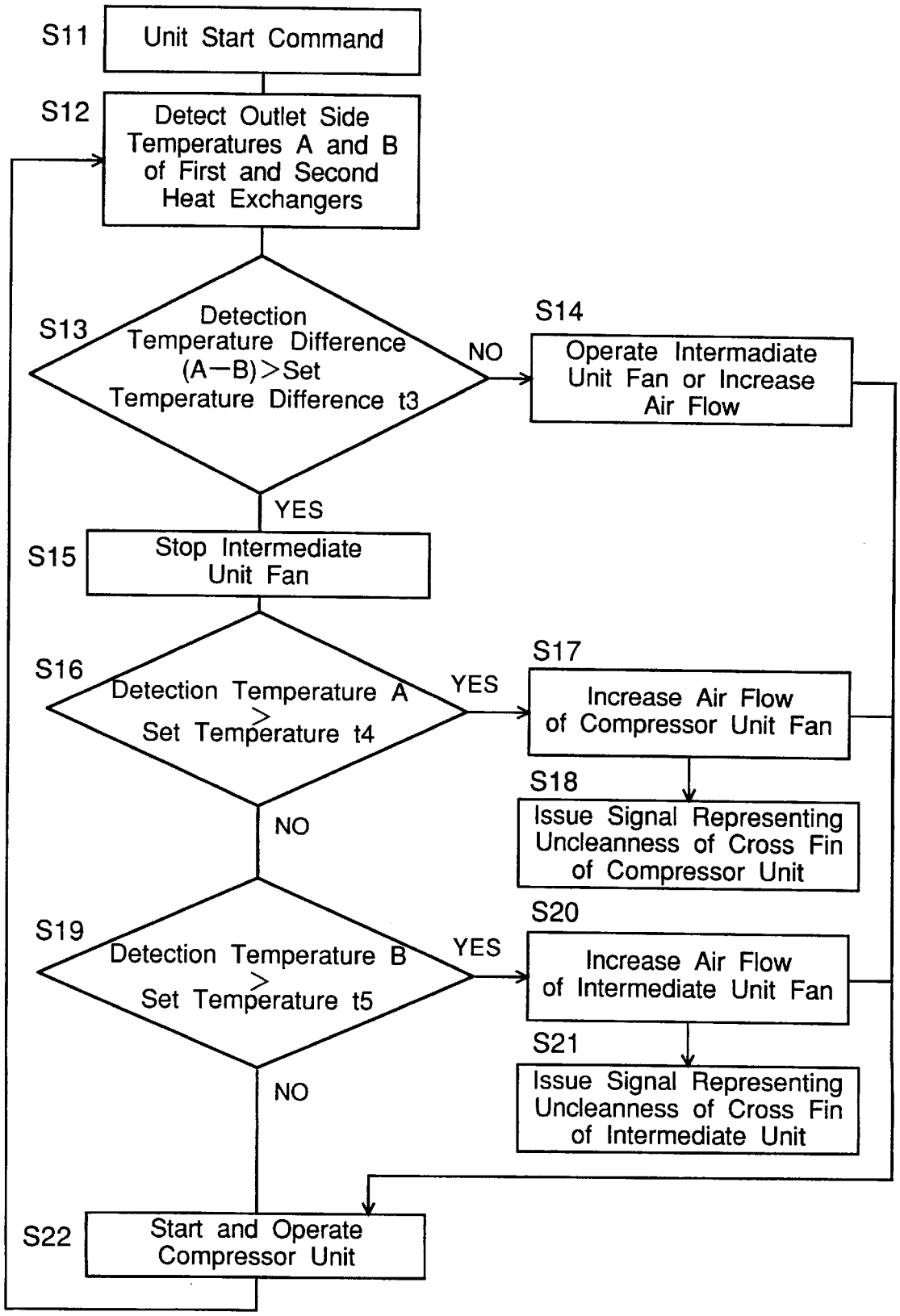
FIG. 5 is a flowchart showing fan control in the second embodiment.

A second embodiment of the present invention will be described next with reference to FIGS. 2 and 5. It is to be noted that the same components as those of the first embodiment are denoted by the same reference numerals and no description is provided therefor. In contrast to the first embodiment in which the outdoor temperature is detected by the outdoor temperature sensor 71, the second embodiment has a construction in which a first temperature sensor 72 is provided on the outlet side of the first air-cooling heat exchanger 12 of the compressor unit 201 and a second temperature sensor 73 is provided on the outlet side of the second air-cooling heat exchanger 31 of an intermediate unit 203, and air flow control of the fan 33 is executed by a controller 206 based on detection results of these first temperature sensor 72 and second temperature sensor 73. This controller 206 includes a microcomputer and is provided with an intermediate unit air flow control section **206*a* and an outdoor unit air flow control section 206*b***.

Specifically, the first temperature sensor 72 is provided for the discharge side piping 21 connected to the outlet side of the first air-cooling heat exchanger 12, the second temperature sensor 73 is provided for the gas supply piping 41 connected to the outlet side of the second air-cooling heat exchanger 31, and a detection temperature A detected by the first temperature sensor 72 and a detection temperature B detected by the second temperature sensor 73 are transmitted to the controller 206.

Air flow control of the fans 14 and 33 in the second embodiment will be described next with reference to the flowchart of FIG. 5. It is now assumed that a set temperature difference t3 set on the basis of the gas temperature of 12° C. at which the refrigerating capacity starts to reduce when the outside air temperature is low and the gas temperature of 32° C. at which the refrigerating capacity starts to reduce due to a gas temperature rise is 20° C. First, a start command for the compressor unit 201 is issued from the controller 206 upon starting the operation of the cryogenic refrigerating apparatus (S11), and in accordance with this start command, the outlet side temperatures A and B of the air-cooling heat exchangers 12 and 31 are detected by the first temperature sensor 72 and the second temperature sensor 73 (S12). When a temperature difference (A–B) between these detection temperatures A and B is smaller than the set temperature difference t3, meaning that sufficient cooling is not performed in the intermediate unit 203, the operation of the fan 33 of the intermediate unit 203 is started (S14). Then, the compressor 11 of the compressor unit 201 is started (S22). Further, the temperatures are detected by the sensors 72 and 73 (S12). When the detection temperature difference (A–B) is still smaller than the set temperature difference t3 (S13), the air flow of the fan 33 of the intermediate unit 203 is increased (S14).

When the detection temperature difference (A–B) is greater than the set temperature difference t3 (S13), meaning that sufficient cooling is performed in the intermediate unit 203, the fan 33 is stopped for the prevention of the super-cooling of the intermediate unit 203 by the fan 33 in this case (S15).

When the detection temperature A on the outlet side of the first air-cooling heat exchanger 12 is higher than a set temperature t4 (60° C., for example) in spite of the fact that the detection temperature difference (A–B) is greater than the set temperature difference t3 (S16), it is decided that the cooling function of the first air-cooling heat exchanger 12 is reduced, and the air flow of the outdoor fan 14 of the compressor unit 201 is increased (S17). It is further decided that the cross fin of the first air-cooling heat exchanger 12 is unclean, and a signal representing the uncleanness of the fin is outputted to a display device i.e. warning device 207 (S18) to issue a warning about the cleaning or the time of replacement of the first air-cooling heat exchanger 12, thereby allowing the refrigerating apparatus to be efficiently operated.

When the detection temperature difference (A–B) is greater than the set temperature difference t3 (S13) and when the detection temperature B on the outlet side of the second air-cooling heat exchanger 31 is higher than a set temperature t5 (38° C., for example) (S19) in spite of the decision that the detection temperature A on the outlet side of the first air-cooling heat exchanger 12 is lower than the set temperature t4 (60° C.) (S16), then it is decided that the cooling function of the second air-cooling heat exchanger 31 is reduced and the air flow of the fan 33 of the intermediate unit 203 is increased. It is further decided that the cross fin of the second air-cooling heat exchanger 31 is unclean, and a signal representing the uncleanness of the fin is outputted to the warning device 207 (S21) to issue a warning about the cleaning or the time of replacement of the second air-cooling heat exchanger 31, thereby allowing the refrigerating apparatus to be efficiently operated.

As described above, in the second embodiment, the temperatures on the outlet side of the air-cooling heat exchangers 12 and 31 are detected by the first temperature sensor 72 and the second temperature sensor 73, thereby detecting a more correct gas temperature, and further the cooling at the intermediate unit 203 is controlled by the detected temperature difference. Therefore, the cooling at the intermediate unit 203 can be more efficiently performed, and the control can be executed so that the fluctuation range of the refrigerating capacity can be further reduced.

Furthermore, the temperatures on the outlet side of the air-cooling heat exchangers 12 and 31 are detected by the first temperature sensor 72 and the second temperature sensor 73, thereby confirming the cooling capacities of the first and second air-cooling heat exchangers 12 and 31. This arrangement enables a decision on the unclean states of the air-cooling heat exchangers 12 and 31, thereby allowing the refrigerating apparatus to be more efficiently operated.

Figure 3:
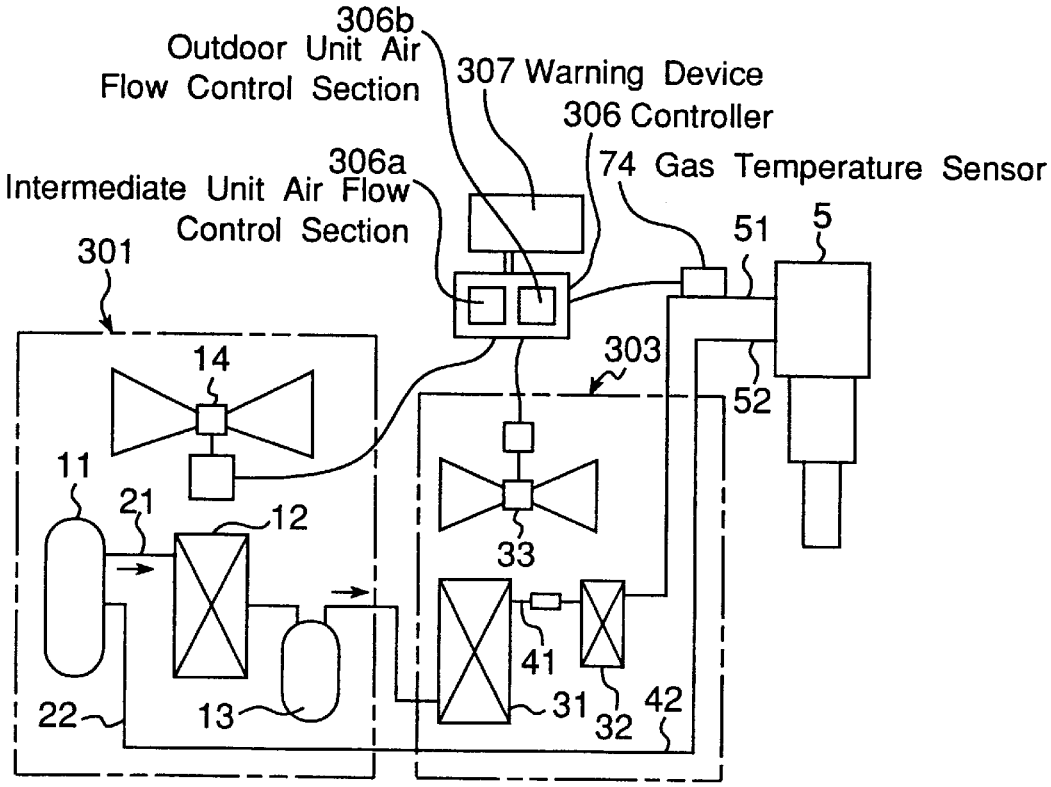
FIG. 3 is a diagram showing a piping system of a cryogenic refrigerating apparatus according to a third embodiment of the present invention.
Figure 6:
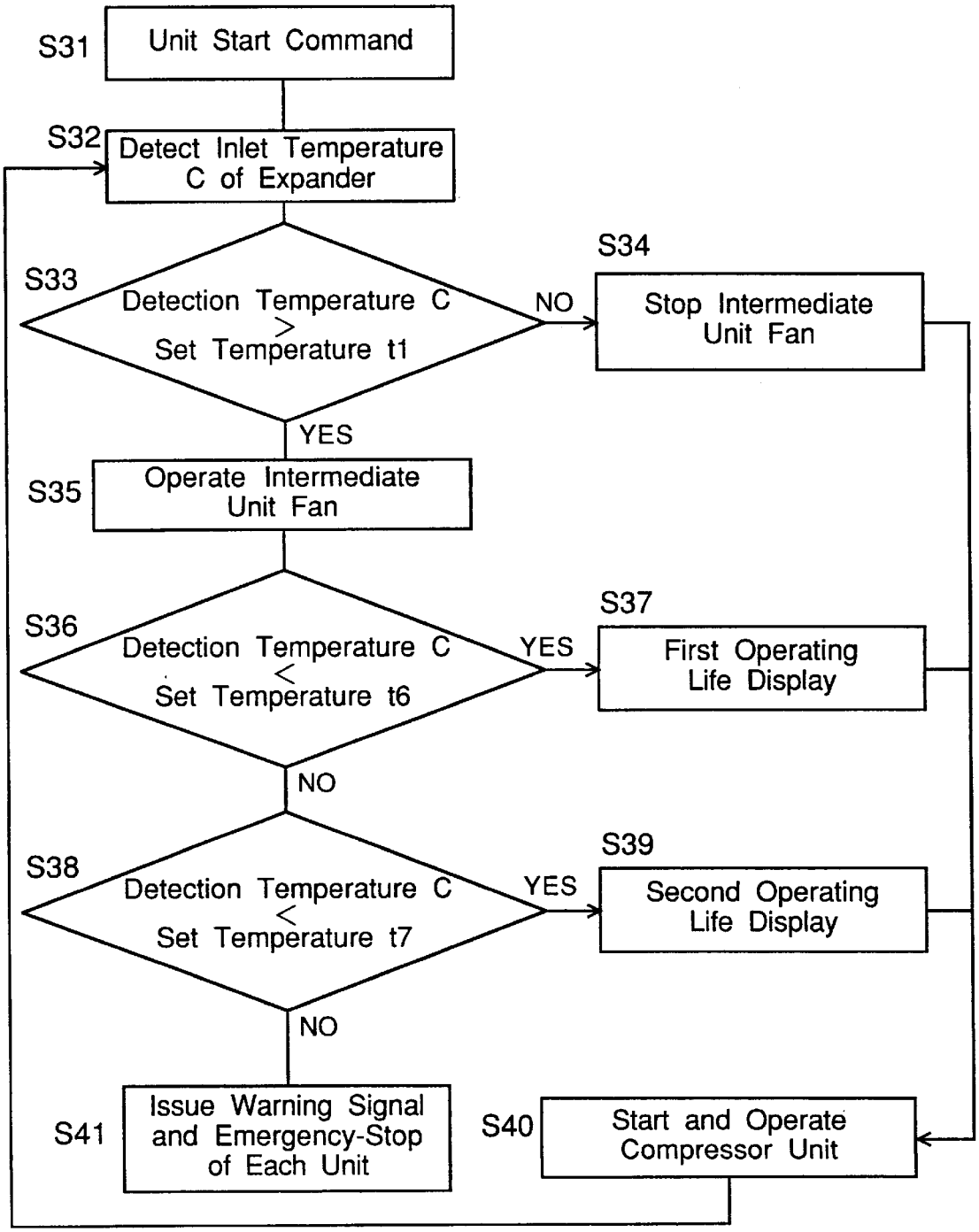
FIG. 6 is a flowchart showing fan control in the third embodiment.

A third embodiment of the present invention will be described next with reference to FIG. 3 and FIG. 6. In FIG. 3, the same components as those of the first and second embodiments shown in FIGS. 1 and 2 are denoted by the same reference numerals and no description is provided therefor. The third embodiment has a construction in which a gas temperature sensor 74 for detecting the gas temperature on the inlet side of the cryogenic expander 5 is provided near the inlet of the cryogenic expander 5 at a high-pressure side communication piping 51 connected to the cryogenic expander 5 and the air flow of the fan 33 is controlled by a controller 306 based on a temperature detection result of the gas temperature sensor 74. This controller 306 is comprised of a microcomputer and includes an intermediate unit air flow control section 306*a* and an outdoor unit air flow control section 306*b*, the controller executing control as shown in FIG. 6.

The air flow control of the fan 33 of the intermediate unit 303 of the third embodiment will be described based on the flowchart of FIG. 6. It is now assumed that the gas temperature of 32° C. at which the refrigerating capacity starts to reduce due to a gas temperature rise is a set temperature t1. Upon starting the operation of the cryogenic refrigerating apparatus, a start command for a compressor unit 301 is issued from the controller 306 (S31), and in accordance with this start command, the temperature on the inlet side of the cryogenic expander 5 is first detected by the gas temperature sensor 74 (S32). When this detection temperature C is lower than the set temperature t1 (32° C.) (S33), no cooling is required at the intermediate unit 303. Therefore, the fan 33 of the intermediate unit 303 is kept stopped (S34), and the compressor 11 and the outdoor fan 14 of the compressor unit 301 are started(S40).

When it is decided that the detection temperature C is lower than the set temperature t1 (32° C.) through the temperature detection by the gas temperature sensor 74 in a case where the fan 33 of the intermediate unit 303 is operated in a state in which the compressor unit 301 is operated, the fan 33 of the intermediate unit 303 is stopped (S34).

When it is decided that the detection temperature C on the inlet side of the cryogenic expander 5 is higher than the set temperature t1 (32° C.) (S33), the cooling capacity of the intermediate unit 303 is required to be increased. Therefore, the fan 33 of the intermediate unit 303 is operated, thereby improving the cooling effect by virtue of the increase in air flow (S35).

In the third embodiment, when it is decided that the detection temperature C is within a range of the set temperature t1 to a set temperature t6 (38° C., for example) in spite of the increase in air flow of the fan 33 at the intermediate unit 303 (S36), the capacity of the whole refrigerating apparatus starts to reduce, and inhalation of high-temperature gas into the cryogenic expander 5 exerts a bad influence on its components. Therefore, in such a case, for the purpose of displaying the operating life of each component of the refrigerating apparatus, a display (first operating life display) for predicting the time of replacement of the components of the cryogenic expander 5 is displayed on a warning device 307 with, for example, a message that the operating time is exceeding 30,000 hours or the remaining operating time based on the 30,000 hours (S37).

When it is decided that the detection temperature C is in a range higher than the set temperature t6 (38° C., for example) and lower than a set temperature t7 (48° C., for example) (S38), the operating life of the refrigerating apparatus is further reduced. Therefore, in such a case, for the purpose of displaying the fact that the operating life of each component of the refrigerating apparatus is running short, a display (second operating life display) for predicting the time of replacement of the components of the cryogenic expander 5 is displayed on the warning device 307 with, for example, a message that the operating time is exceeding 15,000 hours or the remaining operating time based on the 15,000 hours (S39).

When it is decided that the detection temperature C becomes higher than the set temperature t7 (S38), meaning an emergency case, a warning signal is issued to the warning device 307 and the units 301 and 303 are emergency-stopped.

As described above, in the third embodiment, the temperature of the gas immediately before the supply thereof to the cryogenic expander 5 can be detected. Therefore, more correct temperature detection can be achieved, so that the fluctuation range of the refrigerating capacity can be further reduced. Furthermore, by detecting the temperature of the gas immediately before the supply thereof to the cryogenic expander 5, a case where the gas temperature after the cooling in the second air-cooling heat exchanger 31 does not reduce below the set temperature t1 or a similar case can be detected. Therefore, the time of replacement of each component inside the cryogenic expander 5 when it receives a bad influence from the heated gas can be decided, so that the possible occurrence of the damage of the refrigerating apparatus due to the heated gas is detected beforehand, thereby allowing the refrigerating apparatus to be protected by replacing each component or a similar measure.

Although the gas temperature is detected on the inlet side of the cryogenic expander 5 in the third embodiment, it is acceptable to detect the temperature on the outlet side of the cryogenic expander 5.

Industrial Applicability

The cryogenic refrigerating apparatus of this invention is used for superconducting devices, semiconductor manufacturing equipment, communication devices and so forth.

What is claimed is:

1. A cryogenic refrigerating apparatus comprising: a compressor unit (101, 201, 301) which is installed outside a room and has a compressor (11) and a first air-cooling heat exchanger (12) provided in communication with a discharge side piping (21) of the compressor (11); an intermediate unit (103, 203, 303) which is installed inside the room and has a gas supply piping (41) connected to the discharge side piping (21) of the compressor (11) and a second air-cooling heat exchanger (31) which is provided in communication with the gas supply piping (41) and cools helium gas through heat exchange with indoor air; and a cryogenic expander (5) connected to the gas supply piping (41); and characterized by comprising:

a fan (33) for cooling the second air-cooling heat exchanger (31) of the intermediate unit (103, 203, 303); and a controller (6, 206, 306) having an intermediate unit air flow control section (6*a*, 206*a*, 306*a*) which controls air flow of the fan (33) to an increasing side under a condition that a temperature of gas supplied to the cryogenic expander (5) is not lower than a temperature at which a refrigerating capacity starts to reduce due to a temperature rise and controls the air flow of the fan (33) to a decreasing side under a condition that the temperature of the gas supplied to the cryogenic expander (5) is lower than the temperature at which the refrigerating capacity starts to reduce due to the temperature rise.

2. A cryogenic refrigerating apparatus as claimed in claim 1, wherein an outdoor temperature sensor (71) is provided outside the room and the controller (6) controls the air flow of the fan (33) of the intermediate unit (103) based on a detection result of the outdoor temperature sensor (71) when an outdoor temperature detected by the outdoor air temperature sensor is directly related to the temperature of the gas.

3. A cryogenic refrigerating apparatus as claimed in claim 2, wherein an outdoor fan (14) for cooling the first air-cooling heat exchanger (12) of the compressor unit (1) is provided, and the controller (6) has an outdoor unit air flow control section (6*b*) which controls air flow of the outdoor fan (14) to a decreasing side based on detection result of the outdoor temperature sensor (71) when an outside air temperature is low and not higher than a temperature at which the refrigerating capacity starts to reduce.

4. A cryogenic refrigerating apparatus as claimed in claim 1, wherein a first temperature sensor (72) for detecting the temperature of the helium gas on an outlet side of the first air-cooling heat exchanger (12) of the compressor unit (201) and a second temperature sensor (73) for detecting the temperature of the helium gas on an outlet side of the second air-cooling heat exchanger (31) of the intermediate unit (203) are provided, and the controller (206) controls the air flow of the fan (33) of the intermediate unit (203) based on outputs of the first temperature sensor (72) and the second temperature sensor (73).

5. A cryogenic refrigerating apparatus as claimed in claim 1, wherein a gas temperature sensor (74) for detecting the temperature of the gas on an inlet side of the cryogenic expander (5) is provided, and the controller (306) controls the air flow of the fan (33) based on an output of the gas temperature sensor (74).

* * * * *